US010253403B2

(12) United States Patent
Kim et al.

(10) Patent No.: US 10,253,403 B2
(45) Date of Patent: Apr. 9, 2019

(54) METHOD OF MANUFACTURING GRAIN-REFINED ALUMINUM-ZINC-MAGNESIUM-COPPER ALLOY SHEET

(71) Applicant: KOREA INSTITUTE OF MACHINERY AND MATERIALS, Yuseong-gu, Daejeon (KR)

(72) Inventors: Hyoung-Wook Kim, Changwon-si (KR); Yun-Soo Lee, Changwon-si (KR); Cha Yong Lim, Changwon-si (KR); Jae Hyung Cho, Changwon-si (KR)

(73) Assignee: Korea Institute of Machinery and Materials, Daejeon (KR)

( * ) Notice: Subject to any disclaimer, the term of this patent is extended or adjusted under 35 U.S.C. 154(b) by 626 days.

(21) Appl. No.: 14/573,314

(22) Filed: Dec. 17, 2014

(65) Prior Publication Data

US 2015/0114522 A1 Apr. 30, 2015

Related U.S. Application Data

(63) Continuation of application No. PCT/KR2013/010575, filed on Nov. 20, 2013.

(30) Foreign Application Priority Data

Oct. 24, 2013 (KR) ..... 10-2013-0127075

(51) Int. Cl.
*C22F 1/053* (2006.01)
*B22D 11/00* (2006.01)
(Continued)

(52) U.S. Cl.
CPC ..... *C22F 1/053* (2013.01); *B22D 11/003* (2013.01); *B22D 11/0622* (2013.01); *C22C 21/10* (2013.01)

(58) Field of Classification Search
CPC ..... C22C 21/10; C22F 1/053; B22D 11/003; B22D 11/0622
See application file for complete search history.

(56) References Cited

U.S. PATENT DOCUMENTS 5,277,719 A 1/1994 Kuhlman et al.
6,620,265 B2 * 9/2003 Kawahara ..... B22D 11/0622 148/437

(Continued)

FOREIGN PATENT DOCUMENTS

JP 2009144190 7/2009
JP 2012214905 11/2012

(Continued)

OTHER PUBLICATIONS

E. Rooy, Aluminum Alloy Ingot Casting and Continuous Processes, Casting, vol. 15, ASM Handbook, ASM International, 2008, p. 1001-1008.*

(Continued)

*Primary Examiner* — George Wyszomierski
*Assistant Examiner* — Janelle Morillo
(74) *Attorney, Agent, or Firm* — Maine Cernota & Rardin

(57) ABSTRACT

Provided is a method of manufacturing a grain-refined aluminum-zinc-magnesium-copper alloy sheet, including manufacturing an aluminum alloy sheet from an aluminum-zinc-magnesium-copper alloy melt by twin-roll strip casting, primarily rolling the aluminum alloy sheet manufactured in step 1, cold rolling the aluminum alloy sheet manufactured in step 2, and performing a heat treatment on the aluminum alloy sheet manufactured in step 3, thereby reducing processing time and cost by using twin-roll casting. Since grain refinement and homogenization of the sheet manufactured by the twin-roll casting are maximized by sequentially (Continued)

performing warm rolling, cold rolling, and a heat treatment on the sheet, elongation may be improved.

15 Claims, 3 Drawing Sheets

(51) Int. Cl.
*B22D 11/06* (2006.01)
*C22C 21/10* (2006.01)

(56) References Cited

U.S. PATENT DOCUMENTS

2012/0055588 A1* 3/2012 Kamat ..... C22C 21/10
148/551
2015/0064058 A1* 3/2015 Kim ..... C22C 21/08
420/532

FOREIGN PATENT DOCUMENTS

KR 1020070087137 A 8/2007
KR 1020110011228 A 2/2011
KR 1020120135546 A 12/2012

OTHER PUBLICATIONS

Davis, J.R. "Aluminum and Aluminum Alloys", ASM International, 1993, p. 23, 24, 45, 46, 59-62.*

* cited by examiner

METHOD OF MANUFACTURING GRAIN-REFINED ALUMINUM-ZINC-MAGNESIUM-COPPER ALLOY SHEET

RELATED APPLICATIONS

This application is a US Bypass of PCT/KR2013/010575, filed on Nov. 20, 2013, which claims benefit of KR 10-2013-0127075, filed Oct. 24, 2013. Each of these applications is herein incorporated by reference in their entirety for all purposes.

FIELD OF THE INVENTION

The present disclosure relates to a method of manufacturing a grain-refined aluminum-zinc-magnesium-copper alloy sheet, and more particularly, to a method of manufacturing a grain-refined aluminum-zinc-magnesium-copper alloy sheet, in which an aluminum-zinc-magnesium-copper alloy sheet is formed by twin-roll strip casting and a post-processing heat treatment including cold rolling is then performed.

BACKGROUND OF THE INVENTION

Recently, in line with the reinforcement of environmental regulations at home and abroad, material industry as well as automobile industry is searching for a solution for fuel economy as energy saving and pollution prevention measures.

In general, as a solution for improving fuel economy, improvement of engine efficiency, reduction of running resistance, and weight reduction in automotive bodies have been considered. However, the most effective method is the weight reduction in automotive bodies, and it is known that an improvement in fuel economy of about 10% can be achieved by a weight reduction of 10%.

Accordingly, research to replace conventional steel with an aluminum alloy having low weight and high strength has been actively conducted.

However, a high-strength aluminum sheet currently manufactured has a high cost structure because the sheet is manufactured through complex processes, such as a heat treatment after ingot casting, hot rolling, and cold rolling, and the control of the sizes of crystallization phases and inclusions may be difficult because the ingot is cast in the form of a large slab.

Thus, in order to widely apply an aluminum alloy to automotive components, there is a need to improve various properties, such as specific strength and formability, and simultaneously, develop low-cost manufacturing process technology which may secure cost competitiveness by minimizing an increase in cost accompanying during the replacement of the conventional steel.

As the manufacturing process technology of a metal sheet, twin-roll casting is a process which can directly manufacture a sheet from a melt by the unification of two processes such as casting and hot rolling, wherein the twin-roll casting has many metallurgical advantages because it is possible to control fine cast structure and crystallization phases, which are difficult to be obtained by typical ingot casting due to a high cooling rate during the casting.

With respect to conventional twin-roll casting, it has been introduced to manufacture low-alloyed aluminum alloy sheets, in which microstructural control is relatively easy due to a small deviation in temperature range of a solid-liquid coexistence region, at an economic cost. However, recently, research for manufacturing high-strength high-alloyed aluminum sheets by precise process control has been attempted.

However, with respect to twin-roll casting of high-alloyed aluminum alloy, a deviation in the size of dissolved elements and precipitates between a surface portion and a center portion of a sheet may occur due to the difference in cooling rates, and this causes a microstructural inhomogenization which can deteriorate mechanical properties of the sheet during a post-processing heat treatment.

Therefore, microstructural control by appropriate post-processing and heat treatment process is required.

A composition and tensile properties of an AA7075 alloy sheet, which are currently commercially used, are respectively present in Tables 1 and 2 below.

TABLE 1

| | Alloy composition/wt % | | | | | | | | | |
|---|---|---|---|---|---|---|---|---|---|---|
| Alloy | Al | Zn | Cu | Mg | Cr | Mn | Ti | Si | Fe | Others |
| 7075-T4 | bal. | 5.10-6.10 | 1.20-2.00 | 2.10-2.90 | 0.18-0.28 | ≤0.30 | ≤0.20 | ≤0.40 | ≤0.50 | ≤0.15 |

TABLE 2

| | Tensile properties | | |
|---|---|---|---|
| Alloy | Yield strength/MPa | Tensile strength/MPa | Elongation/% |
| 7075-T4 | 205 | 395 | 12 |

As the prior art related to a method of manufacturing an aluminum alloy sheet, Korean Patent Application Laid-Open Publication No. 10-2012-0135546 discloses a method of manufacturing a scandium-added aluminum alloy including performing a solution treatment and natural aging for increasing strength and elongation of the scandium-added aluminum alloy. Specifically, disclosed is the method of manufacturing a scandium-added aluminum alloy including performing a solution treatment for controlling a recrystallized fraction and the amount of vacancy clusters formed, and increasing elongation after casting and performing a homogenization treatment on an aluminum-zinc-(magnesium)-(copper)-(zirconium)-(titanium)-scandium (Al—Zn—(Mg)—(Cu)—(Zr)—(Ti)—Sc) alloy; and performing natural aging for increasing strength by being precipitated as Guinier-Preston (GP) zones during holding at room temperature.

However, in the case that an aluminum alloy is prepared by the above manufacturing method, a degree of improving elongation may be insignificant.

What is needed, therefore is a method of manufacturing an aluminum-zinc-magnesium-copper alloy sheet having improved elongation by controlling a microstructure of the aluminum alloy sheet.

SUMMARY OF THE INVENTION

One embodiment of the present invention provides a method of manufacturing a grain-refined aluminum-zinc-magnesium-copper alloy sheet.

Another embodiment of the present invention is to provide a grain-refined aluminum-zinc-magnesium-copper alloy sheet manufactured according to the above method.

Such an embodiment of the present invention provides a method of manufacturing a grain-refined aluminum-zinc-magnesium-copper alloy sheet including:

manufacturing an aluminum alloy sheet from an aluminum-zinc-magnesium-copper alloy melt by twin-roll strip casting (step 1);

primarily rolling the aluminum alloy sheet manufactured in step 1 (step 2);

cold rolling the aluminum alloy sheet manufactured in step 2 (step 3); and performing a heat treatment on the aluminum alloy sheet manufactured in step 3 (step 4).

Embodiments of the present invention also provide a grain-refined aluminum-zinc-magnesium-copper alloy sheet manufactured according to the method of manufacturing an aluminum-zinc-magnesium-copper alloy sheet.

The method of manufacturing an aluminum-zinc-magnesium-copper alloy sheet according to embodiments of the present invention may reduce processing time and cost by manufacturing an aluminum-zinc-magnesium-copper alloy sheet using twin-roll casting.

Also, since grain refinement and homogenization of the sheet manufactured by the twin-roll casting are maximized by sequentially performing warm rolling, cold rolling, and a heat treatment on the sheet, elongation may be improved.

Furthermore, since strength-ductility balance including elongation of the aluminum sheet manufactured by the above manufacturing method is significantly improved, the aluminum sheet may be suitable for lightweight vehicle parts and structural material.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
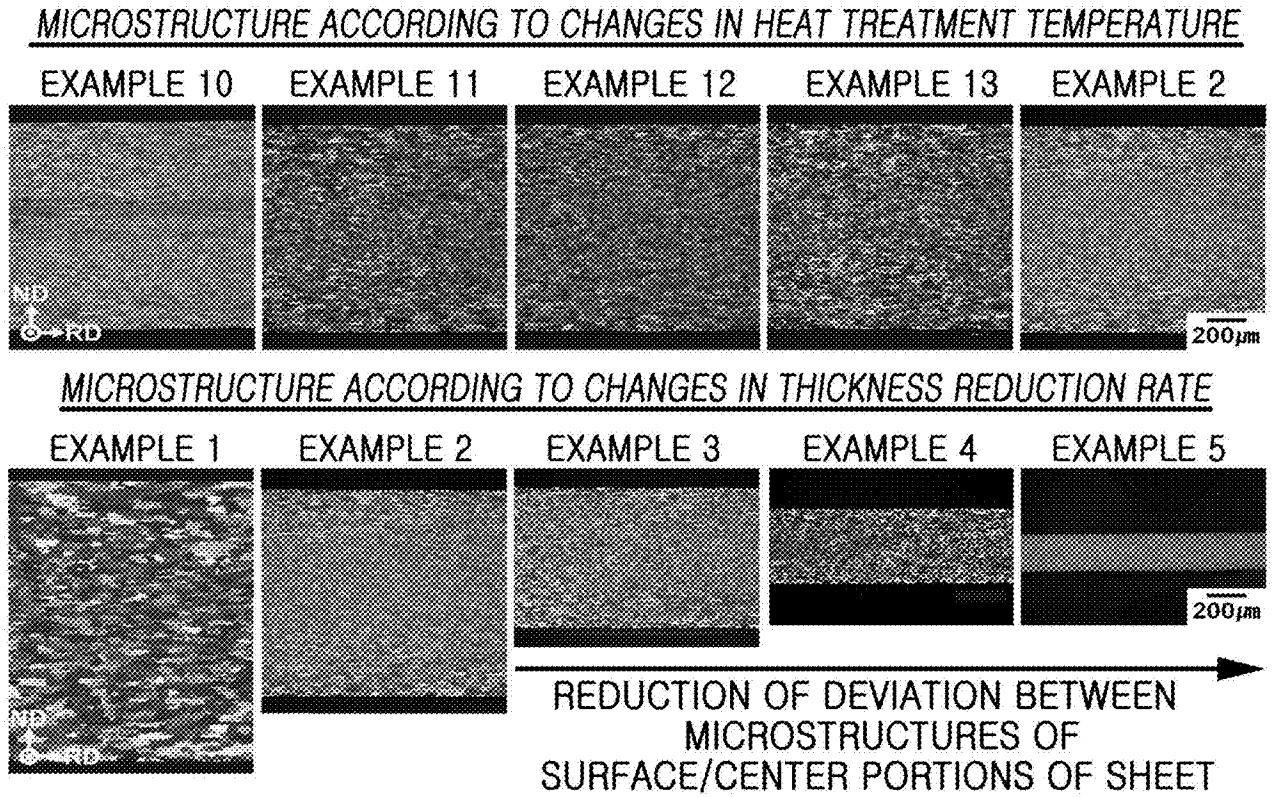
FIG. 1 is images showing microstructures of aluminum-zinc-magnesium-copper alloy sheets manufactured in Examples 1 to 5 and 10 to 13.

Emodiments of the present invention provide a method of manufacturing an aluminum-zinc-magnesium-copper alloy sheet including:

manufacturing an aluminum alloy sheet from an aluminum-zinc-magnesium-copper alloy melt by twin-roll strip casting (step 1);

primarily rolling the aluminum alloy sheet manufactured in step 1 (step 2);

cold rolling the aluminum alloy sheet manufactured in step 2 (step 3); and performing a heat treatment on the aluminum alloy sheet manufactured in step 3 (step 4).

Hereinafter, the method of manufacturing an aluminum-zinc-magnesium-copper alloy sheet according to embodiments of the present invention will be described in detail for each step.

In the manufacturing method of one embodiment of the present invention, step 1 is a step of manufacturing an aluminum alloy sheet from an aluminum-zinc-magnesium-copper alloy melt by twin-roll strip casting.

With respect to the aluminum-zinc-magnesium-copper alloy, i.e., a 7000 series aluminum alloy, zinc (Zn) is added to increase strength but casting defects may be easily formed due to a wide solid-liquid coexistence region. Thus, it is known that twin-roll strip casting is difficult to be applied to the aluminum-zinc-magnesium-copper alloy. According to the prior art, in order to manufacture a 7000 series aluminum alloy sheet, an aluminum alloy melt is first prepared as an ingot and a rolling process is then performed thereon.

Thus, one embodiment of in the present invention, the above-described limitations of the prior art are addressed, a method of manufacturing a 7000 series aluminum alloy by strip casting is provided, and an aluminum-zinc-magnesium-copper alloy melt is manufactured as an aluminum alloy sheet by twin-roll strip casting in step 1.

The aluminum-zinc-magnesium-copper alloy melt may include 5.0 wt % to 6.0 wt % of Zn, 2.0 wt % to 3.0 wt % of magnesium (Mg), 1.0 wt % to 2.0 wt % of copper (Cu), and residual aluminum (Al).

In the case that the aluminum alloy melt includes Zn, Mg, and Cu within the above amount ranges, there is an effect of improving the strength of the aluminum alloy sheet manufactured from the melt.

In particular, Zn, as a main alloying element, may be added in an amount of 5.0 wt % to 6.0 wt % to the aluminum alloy melt.

In the case that the amount of Zn is less than 5.0 wt %, the strength of the aluminum alloy sheet manufactured from the melt may be reduced. In the case in which the amount of Zn is greater than 6.0 wt %, since the fluidity of the melt may decrease to generate a phenomenon in which a nozzle inlet is partially clogged during twin-roll strip casting, it may be difficult to continuously manufacture sound sheets.

However, the composition of the alloy melt is not limited thereto, and a metal composition suitable for a 7000 series aluminum alloy may be appropriately selected and used.

The twin-roll strip casting of step 1 may be performed under conditions including a roll speed of 2 m/min to 10 m/min and a roll gap of 2 mm to 10 mm, and for example, may be performed under conditions including a roll speed of 4 m/min to 6 m/min and a roll gap of 3.0 mm to 4.5 mm.

Specifically, in order to manufacture the aluminum-zinc-magnesium-copper alloy melt in the form of a sheet, the twin-roll casting is performed by passing the aluminum-zinc-magnesium-copper alloy melt between two rolls rotating at a speed of 4 m/min to 6 m/min.

In this case, the two rolls, as horizontal type rolls, are horizontally disposed and are vertically spaced apart by a gap of 2 mm to 10 mm, for example, 3.0 mm to 4.5 mm. A cooling process is performed in which the aluminum alloy melt is cooled by cooling water flowing in the rolls while being transported between the rolls.

In the case that the roll speed is less than 2 m/min, since the melt passes though the rolls after the melt is solidified due to the excessively low roll speed, roll separating force may increase. As a result, many cracks may occur in the manufactured sheet. In contrast, in the case in which the roll speed is greater than 10 m/min, since the melt flows down, the sheet may not be manufactured.

Also, in the case that the gap between the rolls is less than 2 mm, since a thickness of the manufactured sheet is small, it may be difficult to perform a post-processing heat treatment. In the case in which the gap between the rolls is greater than 10 mm, since the thickness of the sheet is large, the post-processing heat treatment must be performed in many times.

The aluminum alloy sheet manufactured by the twin-roll strip casting of step 1 may have a thickness of 2 mm to 10 mm.

In the case that the thickness of the manufactured sheet is less than 2 mm, since the thickness is small, it may be difficult to perform a post-processing heat treatment. In the case in which the thickness of the manufactured sheet is greater than 10 mm, since the thickness is large, the post-processing heat treatment must be performed in many times.

In the manufacturing method of one embodiment of the present invention, step 2 is a step of primarily rolling the aluminum alloy sheet manufactured in step 1.

Specifically, the primary rolling may be performed as warm rolling, and the primary rolling may be performed by passing the aluminum alloy sheet manufactured by the twin-roll casting in step 1 between two rolls which are heated at a temperature of 200° C. to 300° C. and rotate at a speed of 4 m/min to 6 m/min.

In the case that the roll temperature is less than 200° C., rolling defects due to the occurrence of cracks may increase. In the case in which the roll temperature is greater than 300° C., a sticking phenomenon may occur on the surface of the roll and facility management may be difficult.

Also, in the case that the roll speed is less than 4 m/min, the occurrence of shear deformation, which assists the improvement of sheet formability by providing rolling deformation to the entire sheet, may be difficult. In the case in which the roll speed is greater than 6 m/min, the deformation may not occur to the center of the sheet.

The primary rolling of step 2 may be performed at a reduction rate of 18% to 32%, for example, an average reduction rate of 25%.

In the case that the reduction rate is less than 18%, since repeated rolling must be performed in many times, processing time and cost may increase. In the case in which the reduction rate is greater than 32%, severe cracks may occur to reduce surface quality and mechanical properties.

The primary rolling of step 2 may be repeatedly performed until the thickness of the sheet subjected to the rolling is reduced to 20% to 60% of the thickness of the sheet before the rolling, and the repeated rolling may be performed twice to 5 times.

Before the primary rolling of step 2, the manufacturing method of embodiments of the present invention may further include annealing the alloy sheet manufactured in step 1 in a temperature range of 350° C. to 450° C. for 30 minutes to 120 minutes.

The annealing, as a process of heating the twin-roll cast aluminum alloy sheet at a predetermined temperature and then slowly cooling the sheet, is a process of homogenizing the internal structure of the aluminum alloy sheet and removing stress.

The annealing may be performed by heating the twin-roll cast aluminum alloy sheet in a temperature range of 350° C. to 450° C. for 30 minutes to 120 minutes and then cooling the sheet.

In the case that the annealing is performed at a temperature less than 350° C., internal stress introduced from the previous rolling may not be sufficiently removed. In the case in which the annealing is performed at a temperature greater than 450° C., surface oxidation may increase.

Also, in the case that the annealing is performed for less than 30 minutes, the internal stress may not be sufficiently removed, and in the case in which the annealing is performed for greater than 120 minutes, an excessive amount of energy in terms of energy efficiency may be consumed.

In the method of manufacturing an aluminum-zinc-magnesium-copper alloy sheet of one embodiment of the present invention, since the aluminum alloy sheet manufactured by the twin-roll casting of step 1 maintains a high-temperature state, it may be possible that the annealing is skipped and the primary rolling of step 2 is immediately performed by arranging a twin-roll caster and a rolling mill in a plurality of stands.

In the manufacturing method of one embodiment of the present invention, step 3 is a step of cold rolling the aluminum alloy sheet manufactured in step 2.

Grain refinement and homogenization may be maximized by cold rolling the aluminum alloy sheet subjected to the primary rolling and performing a subsequent heat treatment. Thus, elongation of the sheet may be improved.

In this case, the cold rolling of step 3 may be repeatedly performed until the thickness of the sheet subjected to the rolling is reduced to 38% to 95% of the thickness of the sheet subjected to the primary rolling.

In the case that the rolling is performed at a thickness reduction rate in which the thickness of the sheet subjected to the cold rolling of step 3 is less than 38% of the thickness of the sheet subjected to the primary rolling, since the sheet may not be sufficiently deformed, recrystallization may not sufficiently occur during the heat treatment of subsequent step 4. Thus, the microstructure may be coarse and the deviation may not be removed. In the case in which the rolling is performed at a thickness reduction rate greater than 95%, since the sheet is very thin at a thickness of about 0.2 mm, it may be difficult to be used in actual products.

Before the cold rolling of step 3, the manufacturing method of one embodiment of the present invention may further include annealing the alloy sheet manufactured in step 2 in a temperature range of 350° C. to 450° C. for 30 minutes to 120 minutes.

The annealing may be performed by heating the primary rolled aluminum alloy sheet in a temperature range of 350° C. to 450° C. for 30 minutes to 120 minutes and then cooling the sheet.

In the case that the annealing is performed at a temperature less than 350° C., internal stress introduced from the previous rolling may not be sufficiently removed. In the case in which the annealing is performed at a temperature greater than 450° C., surface oxidation may increase.

Also, in the case that the annealing is performed for less than 30 minutes, the internal stress may not be sufficiently removed, and in the case in which the annealing is performed for greater than 120 minutes, an excessive amount of energy in terms of energy efficiency may be consumed.

In the manufacturing method of one embodiment of the present invention, step 4 is a step of performing a heat treatment on the aluminum alloy sheet manufactured in step 3.

The heat treatment of step 4 may be performed in a temperature range of 400° C. to 550° C. for 50 minutes to 70 minutes, and for example, may be performed in a temperature range of 480° C. to 530° C. for 50 minutes to 70 minutes.

Since the heat treatment of step 4 is performed under the above condition, an aluminum-zinc-magnesium-copper alloy sheet having excellent mechanical properties may be manufactured. In particular, in the case that the heat treatment is performed in a temperature range of 480° C. to 530° C., an aluminum-zinc-magnesium-copper alloy sheet, which maintains mechanical strength and has a higher elongation, may be manufactured.

The aluminum-zinc-magnesium-copper alloy sheet heat-treated in step 4 of the present invention may have an elongation of 24.0% or more, or may have a strength-ductility balance of 8,900 MPa % or more, and the aluminum-zinc-magnesium-copper alloy sheet may satisfy both the elongation and the strength-ductility balance.

Also, a grain diameter of the aluminum-zinc-magnesium-copper alloy sheet heat-treated in step 4 may be in a range of 5 μm to 20 μm.

Since the aluminum-zinc-magnesium-copper alloy sheet manufactured in the present invention may have such a fine grain size by performing appropriate warm rolling, cold rolling, and heat treatment to maximize the grain refinement and homogenization of the sheet, the aluminum-zinc-magnesium-copper alloy sheet may have a high elongation while maintaining the strength. Accordingly, the aluminum-zinc-magnesium-copper alloy sheet may exhibit a high strength-ductility balance.

Also, embodiments of the present invention may provide an aluminum-zinc-magnesium-copper alloy sheet manufactured by the above manufacturing method.

Since the aluminum-zinc-magnesium-copper alloy sheet manufactured according to the present invention is manufactured by using twin-roll casting, processing time and cost may be reduced. Thus, the aluminum-zinc-magnesium-copper alloy sheet may be provided at low price.

Furthermore, since the grain refinement and homogenization of the manufactured sheet are maximized to significantly improve the elongation while maintaining the strength, the sheet may exhibit a high strength-ductility balance. Thus, the manufactured sheet may be suitable for lightweight vehicle parts and structural material.

Hereinafter, the present invention will be described in detail, according to specific examples. However, the following examples are merely provided to allow for a clearer understanding of the present invention, rather than to limit the scope of the present invention.

Control Group

7075-T4, as a commercial aluminum alloy, was compared as a control group.

The aluminum alloy was subjected to a T4 treatment (natural aging).

EXAMPLE 1

Step 1: A horizontal-type twin-roll caster including a cooling water line was used to manufacture an aluminum alloy sheet. Twin rolls having a diameter of 300 mm were used in the horizontal-type twin-roll caster.

An aluminum alloy used was a commercial alloy having the same composition as a commercial AA7075 aluminum alloy. After melting the aluminum alloy at 740° C., an Al-5Ti-1B alloy was added as a grain refiner and completely melted. Then, a degassing treatment was performed by injecting argon gas at 730° C. for 10 minutes.

An aluminum-zinc-magnesium-copper alloy melt prepared at 680° C. was introduced into a tundish formed of a ceramic board having a width of 150 mm. For twin-roll casting, the molten metal was allowed to flow from a melting furnace to the tundish, and, after being introduced into the inlet of the tundish, the molten metal was allowed to be transferred to the surface of the rotating rolls. The molten metal was rapidly solidified by being in contact with the twin rolls that were cooled by cooling water, and passed through the twin rolls. A rotation speed of the twin rolls was 5 m/min and a gap between the twin rolls was 4 mm.

A twin-roll cast aluminum alloy sheet having a thickness of 4.4 mm and a width of 150 mm was manufactured by the above process.

Step 2: The aluminum-zinc-magnesium-copper alloy sheet manufactured in step 1 was annealed at 400° C. for 60 minutes and then subjected to warm rolling. The warm rolling was repeatedly performed at an average reduction rate of 25% under conditions including a rotation speed of upper/lower rolls of 5 m/min and a preheat temperature of 250° C. to reduce the thickness of the sheet to 2.0 mm during the warm rolling.

Step 3: The aluminum-zinc-magnesium-copper alloy sheet primarily rolled in step 2 was again annealed at 400° C. for 60 minutes and then subjected to cold rolling at room temperature.

The rolling was repeatedly performed at a rotation speed of upper/lower rolls of 5 m/min at room temperature to reduce the thickness of the aluminum alloy sheet subjected to the primary rolling in step 2 by 20% so as to have a thickness of 1.6 mm during the cold rolling.

Step 4: The sheet having a thickness of 1.6 mm, which were manufactured in step 3, was heat-treated at 510° C. for 60 minutes and water-cooled to manufacture an aluminum alloy sheet.

EXAMPLE 2

An aluminum alloy sheet was manufactured in the same manner as in Example 1 except that rolling was repeatedly performed to reduce the thickness of the aluminum alloy sheet subjected to the primary rolling in step 3 of Example 1 by 40% so as to have a thickness of 1.2 mm.

EXAMPLE 3

An aluminum alloy sheet was manufactured in the same manner as in Example 1 except that rolling was repeatedly performed to reduce the thickness of the aluminum alloy sheet subjected to the primary rolling in step 3 of Example 1 by 60% so as to have a thickness of 0.8 mm.

EXAMPLE 4

An aluminum alloy sheet was manufactured in the same manner as in Example 1 except that rolling was repeatedly performed to reduce the thickness of the aluminum alloy sheet subjected to the primary rolling in step 3 of Example 1 by 80% so as to have a thickness of 0.4 mm.

EXAMPLE 5

An aluminum alloy sheet was manufactured in the same manner as in Example 1 except that rolling was repeatedly performed to reduce the thickness of the aluminum alloy sheet subjected to the primary rolling in step 3 of Example 1 by 90% so as to have a thickness of 0.2 mm.

EXAMPLE 6

An aluminum alloy sheet was manufactured in the same manner as in Example 1 except that a heat treatment was performed at 410° C. in step 4 of Example 1.

EXAMPLE 7

An aluminum alloy sheet was manufactured in the same manner as in Example 1 except that a heat treatment was performed at 440° C. in step 4 of Example 1.

EXAMPLE 8

An aluminum alloy sheet was manufactured in the same manner as in Example 1 except that a heat treatment was performed at 460° C. in step 4 of Example 1.

EXAMPLE 9

An aluminum alloy sheet was manufactured in the same manner as in Example 1 except that a heat treatment was performed at 490° C. in step 4 of Example 1.

EXAMPLE 10

An aluminum alloy sheet was manufactured in the same manner as in Example 2 except that a heat treatment was performed at 410° C. in step 4 of Example 2.

EXAMPLE 11

An aluminum alloy sheet was manufactured in the same manner as in Example 2 except that a heat treatment was performed at 440° C. in step 4 of Example 2.

EXAMPLE 12

An aluminum alloy sheet was manufactured in the same manner as in Example 2 except that a heat treatment was performed at 460° C. in step 4 of Example 2.

EXAMPLE 13

An aluminum alloy sheet was manufactured in the same manner as in Example 2 except that a heat treatment was performed at 490° C. in step 4 of Example 2.

EXAMPLE 14

An aluminum alloy sheet was manufactured in the same manner as in Example 3 except that a heat treatment was performed at 410° C. in step 4 of Example 3.

EXAMPLE 15

An aluminum alloy sheet was manufactured in the same manner as in Example 3 except that a heat treatment was performed at 440° C. in step 4 of Example 3.

EXAMPLE 16

An aluminum alloy sheet was manufactured in the same manner as in Example 3 except that a heat treatment was performed at 460° C. in step 4 of Example 3.

EXAMPLE 17

An aluminum alloy sheet was manufactured in the same manner as in Example 3 except that a heat treatment was performed at 490° C. in step 4 of Example 3.

EXAMPLE 18

An aluminum alloy sheet was manufactured in the same manner as in Example 4 except that a heat treatment was performed at 410° C. in step 4 of Example 4.

EXAMPLE 19

An aluminum alloy sheet was manufactured in the same manner as in Example 4 except that a heat treatment was performed at 440° C. in step 4 of Example 4.

EXAMPLE 20

An aluminum alloy sheet was manufactured in the same manner as in Example 4 except that a heat treatment was performed at 460° C. in step 4 of Example 4.

EXAMPLE 21

An aluminum alloy sheet was manufactured in the same manner as in Example 4 except that a heat treatment was performed at 490° C. in step 4 of Example 4.

EXAMPLE 22

An aluminum alloy sheet was manufactured in the same manner as in Example 5 except that a heat treatment was performed at 410° C. in step 4 of Example 5.

EXAMPLE 23

An aluminum alloy sheet was manufactured in the same manner as in Example 5 except that a heat treatment was performed at 440° C. in step 4 of Example 5.

EXAMPLE 24

An aluminum alloy sheet was manufactured in the same manner as in Example 5 except that a heat treatment was performed at 460° C. in step 4 of Example 5.

EXAMPLE 25

An aluminum alloy sheet was manufactured in the same manner as in Example 5 except that a heat treatment was performed at 490° C. in step 4 of Example 5.

COMPARATIVE EXAMPLE 1

An aluminum alloy sheet was manufactured in the same manner as in Example 1 except that a preheat temperature was set to be 250° C. in step 3 of Example 1, warm rolling was repeatedly performed to reduce the thickness of the aluminum alloy sheet subjected to the primary rolling by 50% so as to have a thickness of 1.0 mm, and a heat treatment was performed at 460° C. in step 4.

COMPARATIVE EXAMPLE 2

An aluminum alloy sheet was manufactured in the same manner as in Comparative Example 1 except that a heat treatment was performed at 490° C. in step 4 of Comparative Example 1.

COMPARATIVE EXAMPLE 3

An aluminum alloy sheet was manufactured in the same manner as in Comparative Example 1 except that a heat treatment was performed at 510° C. in step 4 of Comparative Example 1.

TABLE 3

| | Rolling method of step 3 | Final reduction rate of step 3 (%) | Heat treatment temperature of step 4 (° C.) |
|---|---|---|---|
| Example 1 | Cold | 20 | 510 |
| Example 2 | Cold | 40 | 510 |
| Example 3 | Cold | 60 | 510 |
| Example 4 | Cold | 80 | 510 |
| Example 5 | Cold | 90 | 510 |
| Example 6 | Cold | 20 | 410 |
| Example 7 | Cold | 20 | 440 |
| Example 8 | Cold | 20 | 460 |
| Example 9 | Cold | 20 | 490 |
| Example 10 | Cold | 40 | 410 |
| Example 11 | Cold | 40 | 440 |
| Example 12 | Cold | 40 | 460 |
| Example 13 | Cold | 40 | 490 |
| Example 14 | Cold | 60 | 410 |
| Example 15 | Cold | 60 | 440 |
| Example 16 | Cold | 60 | 460 |
| Example 17 | Cold | 60 | 490 |
| Example 18 | Cold | 80 | 410 |
| Example 19 | Cold | 80 | 440 |
| Example 20 | Cold | 80 | 460 |
| Example 21 | Cold | 80 | 490 |
| Example 22 | Cold | 90 | 410 |
| Example 23 | Cold | 90 | 440 |
| Example 24 | Cold | 90 | 460 |
| Example 25 | Cold | 90 | 490 |
| Comparative Example 1 | warm | 50 | 460 |
| Comparative Example 2 | warm | 50 | 490 |
| Comparative Example 3 | warm | 50 | 510 |

EXPERIMENTAL EXAMPLE 1

Microstructural Observation of Aluminum Alloy Sheet

In order to investigate microstructures of the aluminum-zinc-magnesium-copper alloy sheets manufactured in Examples 1 to 5 and 10 to 13, sides (side formed by a rolling direction and a direction perpendicular to the surface of the sheet) of the aluminum alloy sheets were observed with an optical microscope, and the results thereof are presented in FIG. 1. Diameters and aspect ratios of grains of the aluminum-zinc-magnesium-copper alloy sheets manufactured in Examples 1 to 25 were investigated, and the results thereof are presented in FIGS. 2 and 3.

As illustrated in FIG. 1, it may be confirmed that a grain diameter of the sheet, which was repeatedly cold-rolled at room temperature so as to reduce the thickness of the primary rolled sheet according to the present invention by 40% (1.2 mm), was deceased from 40 μm to 25 μm as the heat treatment temperature was increased from 410° C. to 510° C., that is, as we move from Example 10 to Examples 13 and 2. This result was due to the fact that with respect to the same thickness reduction rate (amount of rolling), the higher the heat treatment temperature was, the easier the recrystallization was.

Also, in the case that the heat treatment was performed on the sheet, which was repeatedly cold-rolled at room temperature so as to reduce the thickness of the primary rolled sheet by 20% to 90% (1.6 mm to 0.2 mm), at 510° C., it may be confirmed that the gain size was decreased from 50 μm to 10 μm as the thickness reduction rate increased, that is, as we move from Example 1 to Example 5.

Thus, it may be understood that grains were refined as the heat treatment temperature of step 4 increased or the thickness reduction rate during the cold rolling of step 3 was higher.

Figure 2:
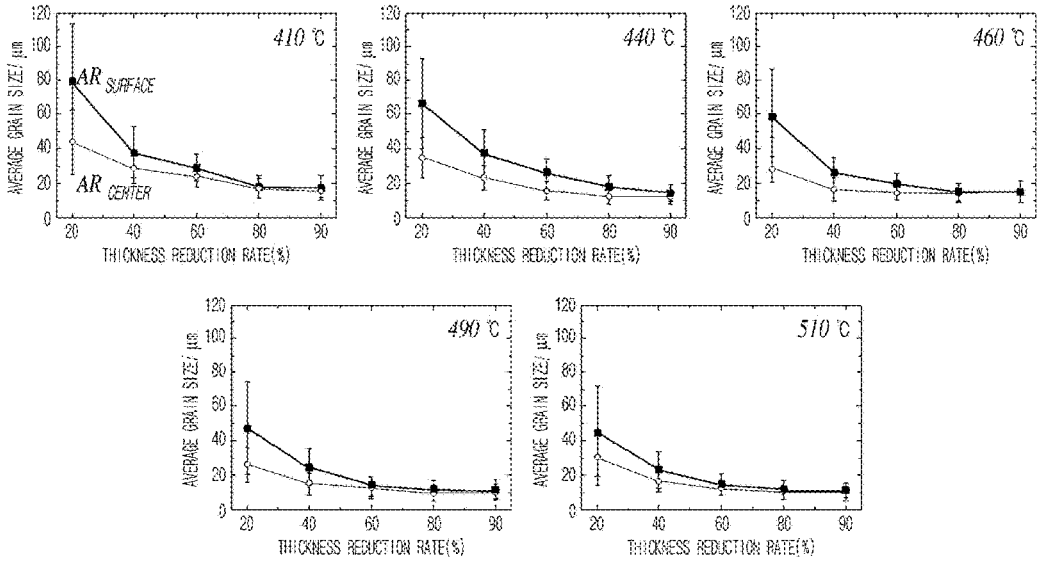
FIG. 2 is graphs illustrating the results of measuring grain sizes of a surface portion (surface in a thickness direction) and a center portion (center in a thickness direction) of aluminum-zinc-magnesium-copper alloy sheets manufactured in Examples 1 to 25.
Figure 3:
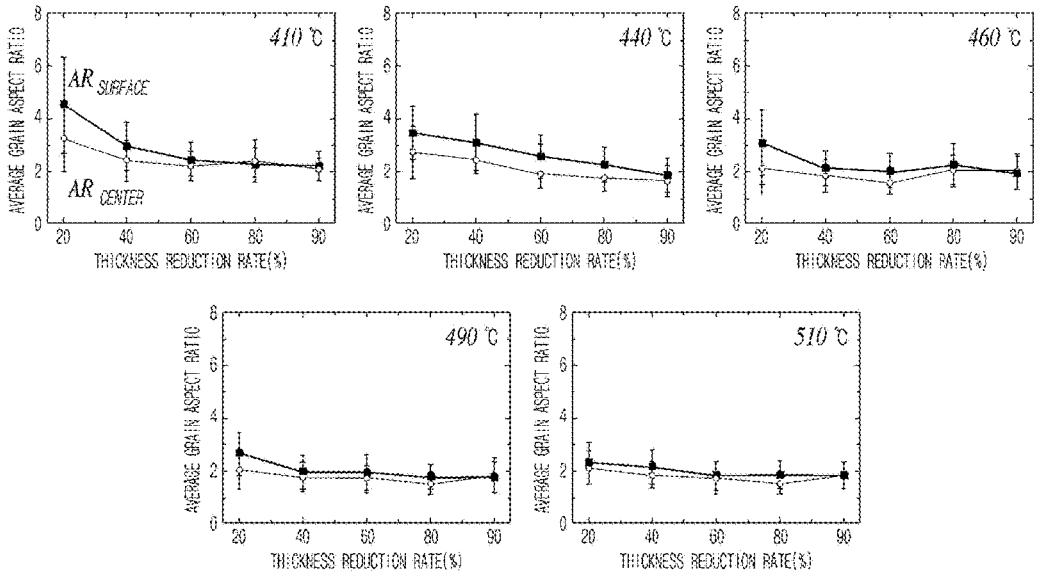
FIG. 3 is graphs illustrating the results of measuring grain aspect ratios of the surface portion (surface in a thickness direction) and the center portion (center in a thickness direction) of the aluminum-zinc-magnesium-copper alloy sheets manufactured in Examples 1 to 25.

Also, as illustrated in FIGS. 2 and 3, the difference in average grain sizes between the surface and the center of the sheet tended to decrease as the heat treatment temperature increased or the thickness reduction rate during the cold rolling was higher.

In this case, the grain aspect ratio may be calculated by Equation 1 below.

Gain aspect ratio=length of grain in a rolling direction(RD)/length of grain in a transverse direction(TD) Equation 1

Thus, it may be understood that grains were refined, the gain aspect ratio was decreased, and the deviation between the surface portion and the center portion of the sheet disappeared as the final thickness was more reduced during the cold rolling and the heat treatment temperature was more increased.

EXPERIMENTAL EXAMPLE 2

Investigation of Mechanical Strength of Aluminum Alloy Sheet

In order to investigate mechanical properties of a control group and the aluminum alloy sheets manufactured in Examples 1 to 5 and Comparative Examples 1 to 3, tensile specimens having a gauge length of 25 mm, a gauge width of 6 mm, and a final sheet thickness were prepared and tensile tests were performed at a crosshead speed of 1 mm/min. The results thereof are presented in Table 4 and FIG. 4.

TABLE 4

| | Tensile strength/MPa | Elongation (%) | Strength-ductility balance (MPa %) |
|---|---|---|---|
| Example 1 | 373.0 | 20.5 | 7646.5 |
| Example 2 | 393.7 | 24.0 | 9448.8 |

TABLE 4-continued

| | Tensile strength/MPa | Elongation (%) | Strength-ductility balance (MPa %) |
|---|---|---|---|
| Example 3 | 362.4 | 24.8 | 8987.5 |
| Example 4 | 370.9 | 26.6 | 9865.9 |
| Example 5 | 365.2 | 25.3 | 9239.6 |
| Comparative Example 1 | 442.8 | 7.9 | 3498.1 |
| Comparative Example 2 | 431.4 | 9.1 | 3925.7 |
| Comparative Example 3 | 438.7 | 17.3 | 7589.5 |
| Control group | 395.0 | 12.0 | 4740.0 |

Figure 4:
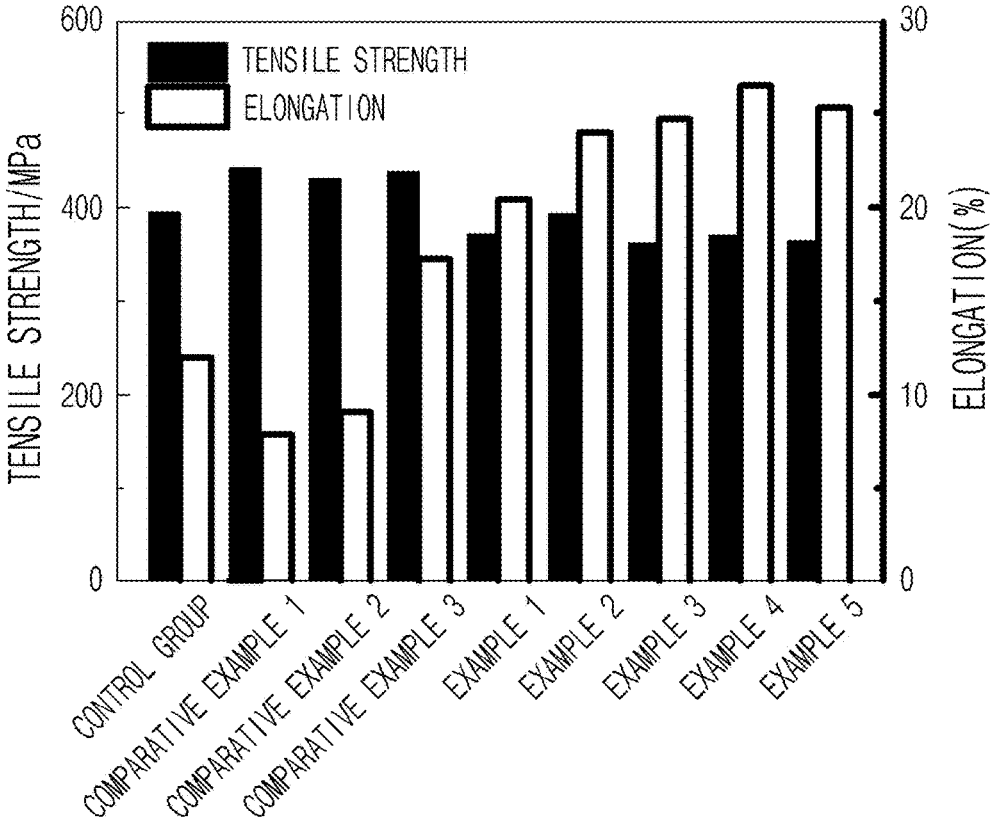
FIG. 4 is a graph illustrating tensile strengths and elongations of a control group and aluminum-zinc-magnesium-copper alloy sheets manufactured in Examples 1 to 5 and Comparative Examples 1 to 3.

As illustrated in Table 4 and FIG. 4, the aluminum alloy sheets manufactured in Examples 2 to 5 exhibited an ultimate tensile strength of 360 MPa to 395 MPa and an elongation of 24% to 27%, and the commercial aluminum alloy, as the control group, exhibited an ultimate tensile strength of 395 MPa and an elongation of 12%.

Also, Comparative Examples 1 to 3, in which, different from Examples 1 to 5, warm rolling was performed instead of cold rolling, exhibited an ultimate tensile strength of 430 MPa to 443 MPa and an elongation of 8% to 17%.

Thus, it may be understood that the aluminum alloy sheet of the present invention had a higher elongation than that of the commercial alloy by controlling the microstructure of the sheet by performing subsequent cold rolling and heat treatment after twin-roll strip casting. Furthermore, since the tensile strength was also maintained at a predetermined level, the aluminum alloy sheet of the present invention exhibited a high strength-ductility balance.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A method of manufacturing an aluminum-zinc-magnesium-copper alloy sheet, the method comprising:

manufacturing an aluminum alloy sheet from an aluminum-zinc-magnesium copper alloy melt by twin-roll strip casting (step 1);

primarily warm rolling the aluminum alloy sheet manufactured in step 1 at a roll temperature of 200° C. to 300° C. (step 2);

cold rolling the aluminum alloy sheet manufactured in step 2 repeatedly until the thickness of the sheet subjected to the rolling is reduced to 38~95% of the thickness of the sheet subjected to the primary rolling (step 3); and performing a heat treatment on the aluminum alloy sheet manufactured in step 3 in a temperature range of 400° C. to 550° C. in order that the average grain size of the surface and the center of the sheet is 5~40 μm and the elongation is 20.5% or more (step 4).

2. The method as set forth in claim 1, wherein the aluminum-zinc-magnesium-copper alloy melt comprises 5.0 wt % to 6.0 wt % of zinc (Zn), 2.0 wt % to 3.0 wt % of magnesium (Mg), 1.0 wt % to 2.0 wt % of copper (Cu), and residual aluminum (Al).

3. The method as set forth in claim 1, wherein the twin-roll strip casting of step 1 is performed under conditions including a roll speed of 2 m/min to 10 m/min and a roll gap of 2 mm to 10 mm.

4. The method as set forth in claim 1, wherein the twin-roll strip cast aluminum alloy sheet of step 1 has a thickness of 2 mm to 10 mm.

5. The method as set forth in claim 1, further comprising annealing the aluminum alloy sheet manufactured in step 1 in a temperature range of 350° C. to 450° C. for 30 minutes to 120 minutes, before the primary rolling of step 2.

6. The method as set forth in claim 1, wherein the primary rolling of step 2 is performed at a reduction rate of 18% to 32%.

7. The method as set forth in claim 1, wherein the primary rolling of step 2 is performed at an average reduction rate of 25%.

8. The method as set forth in claim 1, wherein the primary rolling of step 2 is repeatedly performed until a thickness of the sheet subjected to the rolling is reduced to 20% to 60% of a thickness of the sheet before the rolling.

9. The method as set forth in claim 8, wherein the repeated rolling is performed twice to 5 times.

10. The method as set forth in claim 1, further comprising annealing the aluminum alloy sheet manufactured in step 2 in a temperature range of 350° C. to 450° C. for 30 minutes to 120 minutes, before the cold rolling of step 3.

11. The method as set forth in claim 1, wherein the heat treatment of step 4 is performed in a temperature range of 400° C. to 550° C. for 50 minutes to 70 minutes.

12. The method as set forth in claim 1, wherein the aluminum-zinc-magnesium-copper alloy sheet heat-treated in step 4 has an elongation of 24.0% or more.

13. The method as set forth in claim 1, wherein the aluminum-zinc-magnesium-copper alloy sheet heat-treated in step 4 has a strength-ductility balance of 8,900 MPa % or more.

14. The method as set forth in claim 1, wherein a grain diameter of the aluminum-zinc-magnesium-copper alloy sheet heat-treated in step 4 is in a range of 5 μm to 20 μm.

15. The method as set forth in claim 1, wherein the primary rolling of step 2 is performed under conditions including a roll speed of 4 m/min to 6 m/min.

* * * * *